US008039186B2

(12) United States Patent
Sasaki et al.

(10) Patent No.: US 8,039,186 B2
(45) **Date of Patent: *Oct. 18, 2011**

(54) TONER FOR DEVELOPING ELECTROSTATIC IMAGE, DEVELOPER FOR DEVELOPING ELECTROSTATIC IMAGE, AND METHOD FOR FORMING IMAGE

(75) Inventors: Yuki Sasaki, Kanagawa (JP); Fumiaki Mera, Kanagawa (JP); Satoshi Hiraoka, Kanagawa (JP); Hirotaka Matsuoka, Kanagawa (JP); Yasuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 731 days.

This patent is subject to a terminal disclaimer.

(21) Appl. No.: 11/505,918

(22) Filed: Aug. 18, 2006

(65) Prior Publication Data

US 2007/0196758 A1 Aug. 23, 2007

(30) Foreign Application Priority Data

Feb. 23, 2006 (JP) ..... 2006-046249

(51) Int. Cl.
*G03G 9/087* (2006.01)

(52) U.S. Cl. ..... 430/109.4; 430/108.3; 430/108.5

(58) Field of Classification Search ..... 430/108.1, 430/108.4, 109.4, 11.4, 108.3, 108.5
See application file for complete search history.

(56) References Cited

U.S. PATENT DOCUMENTS

| | | | | |
|---|---|---|---|---|
| 4,486,559 | A * | 12/1984 | Murata et al. | 523/468 |
| 5,635,325 | A * | 6/1997 | Inaba et al. | 430/108.4 |
| 6,015,647 | A * | 1/2000 | Ugai et al. | 430/108.4 |
| 7,364,826 | B2 * | 4/2008 | Fujii et al. | 430/108.1 |
| 7,378,210 | B2 * | 5/2008 | Hiraoka et al. | 430/109.4 |
| 7,498,113 | B2 * | 3/2009 | Matsumura et al. | 430/109.4 |
| 7,524,603 | B2 * | 4/2009 | Mera et al. | 430/109.4 |
| 7,629,098 | B2 * | 12/2009 | Matsumura et al. | 430/109.4 |
| 2001/0046636 | A1 * | 11/2001 | Daimon et al. | 430/109.4 |
| 2002/0018952 | A1 * | 2/2002 | Daimon et al. | 430/109.4 |
| 2002/0081516 | A1 * | 6/2002 | Yoon | 430/137.16 |
| 2002/0106573 | A1 * | 8/2002 | Hamano et al. | 430/111.4 |
| 2003/0162112 | A1 * | 8/2003 | Yamashita et al. | 430/108.6 |
| 2003/0175610 | A1 * | 9/2003 | Kitani et al. | 430/109.3 |
| 2003/0190545 | A1 * | 10/2003 | Daimon et al. | 430/124 |
| 2004/0058262 | A1 * | 3/2004 | Serizawa et al. | 430/108.4 |
| 2004/0142266 | A1 * | 7/2004 | Sacripante et al. | 430/109.3 |
| 2004/0162373 | A1 * | 8/2004 | Cheng et al. | 524/392 |
| 2005/0074685 | A1 * | 4/2005 | Kido et al. | 430/110.2 |
| 2006/0057483 | A1 * | 3/2006 | Yanase et al. | 430/108.4 |
| 2006/0166121 | A1 * | 7/2006 | Patel et al. | 430/109.4 |
| 2006/0240353 | A1 * | 10/2006 | Matsumura et al. | 430/109.4 |
| 2006/0263709 | A1 * | 11/2006 | Matsumura et al. | 430/105 |
| 2007/0092821 | A1 * | 4/2007 | Sato et al. | 430/108.4 |
| 2007/0092822 | A1 * | 4/2007 | Matsumura et al. | 430/109.4 |

FOREIGN PATENT DOCUMENTS

| | | | |
|---|---|---|---|
| JP | A-61-188417 | | 8/1986 |
| JP | A-2-308260 | | 12/1990 |
| JP | A 11-313692 | | 11/1999 |
| JP | A-2001-192446 | | 7/2001 |
| JP | 2002/55302 | A | 2/2002 |
| JP | 2002/278139 | A | 9/2002 |
| JP | A-2002-278136 | | 9/2002 |
| JP | A-2003-84501 | | 3/2003 |
| JP | 2003/261662 | A | 9/2003 |
| JP | 2003/306535 | A | 10/2003 |
| JP | A-2004-287269 | | 10/2004 |
| JP | A-2005-49626 | | 2/2005 |
| JP | 2005/91706 | A | 4/2005 |
| JP | A-2005-325266 | | 11/2005 |

OTHER PUBLICATIONS

U.S. Office Action issued Feb. 26, 2010 in related U.S. Appl. No. 12/608,480.
Aug. 4, 2010 Office Action issued in U.S. Appl. No. 12/608,480.
Jul. 20, 2010 Notification of Reasons for Refusal issued in Japanese Patent Application No. 2006-046249.

* cited by examiner

*Primary Examiner* — Hoa Le
(74) *Attorney, Agent, or Firm* — Oliff & Berridge, PLC

(57) ABSTRACT

A toner for developing an electrostatic image comprises: a binder resin; and a releasing agent, wherein the binder resin comprises a polycondensation resin obtained by polycondensing a polycondensation monomer in the presence of a polycondensation catalyst, the releasing agent comprises a condensation compound obtained by condensing a condensation monomer in the presence of a condensation catalyst, the toner contains a metallic element derived from the polycondensation catalyst and the condensation catalyst in an amount of from 0 to 10 ppm, and the toner contains a sulfur component in an amount of from 100 to 20,000 ppm.

17 Claims, No Drawings

TONER FOR DEVELOPING ELECTROSTATIC IMAGE, DEVELOPER FOR DEVELOPING ELECTROSTATIC IMAGE, AND METHOD FOR FORMING IMAGE

BACKGROUND (i) Technical Field

The present invention relates to a toner for developing an electrostatic image that is used for developing an electrostatic latent image formed by an electrophotographic method or an electrostatic recording method with a developer, and a method for producing the same. The invention also relates to a developer for developing an electrostatic image and a method for forming an image that utilize the toner for developing an electrostatic image.

(ii) Related Art

It has been a major issue to improve dispersibility of a releasing agent in a toner. In the case where a releasing agent is dispersed insufficiently, aggregation in the toner or exposure on the toner surface occurs to cause such a problem as releasing agent offset caused by the releasing agent remaining on a photoreceptor, which might adversely affect image quality particularly on a transparent image forming material, such as an OHP sheet.

A vinyl polymer has been widely used as a binder resin of a toner. Upon using a vinyl polymer having a high molecular weight having a high softening temperature, a fixing roller should be set at a high temperature for obtaining a fixed image excellent in glossiness, which is contrary to energy saving.

On the other hand, a polyester resin has high flexibility as compared to a vinyl polymer owing to a rigid aromatic ring contained in the chain, and thus the molecular weight can be set lower for obtaining the same mechanical strength. Furthermore, a polyester resin has such an advantage that it can be easily designed as a resin for being fixed at a low temperature from the standpoint of entanglement of molecular chains and limited molecular weight as compared to a vinyl binder resin, and thus a polyester resin is often used as a binder resin of a toner.

A polycondensation resin and a condensation compound are generally synthesized by using a metallic compound as a catalyst from the standpoint of the high reactivity thereof and prevention of coloration.

An ordinary condensation or polycondensation reaction generally proceeds at a high temperature exceeding 200° C. and highly reduced pressure under agitation with a large driving force for a prolonged period of time of 10 hours or more, which brings about consumption of a large amount of energy. Furthermore, a large amount of spending is often required for the reaction equipments satisfying the necessary durability.

Investigations relating to a method for producing a polyester resin at a low temperature have been reported in recent years.

SUMMARY

A toner for developing an electrostatic image containing at least a binder resin and a releasing agent, the binder resin containing a polycondensation resin obtained by polycondensing a polycondensation monomer in the presence of a polycondensation catalyst, the releasing agent containing a condensation compound obtained by condensing a condensation monomer in the presence of a condensation catalyst, the toner containing a metallic element derived from the polycondensation catalyst and the condensation catalyst in an amount of from 0 to 10 ppm, the toner containing a sulfur component in an amount of from 100 to 20,000 ppm.

DETAILED DESCRIPTION

The toner for developing an electrostatic image (hereinafter, sometimes simply referred to as a toner) of the invention contains at least a binder resin and a releasing agent, the binder resin contains a polycondensation resin obtained by polycondensing a polycondensation monomer in the presence of a polycondensation catalyst, the releasing agent contains a condensation compound obtained by condensing a condensation monomer in the presence of a condensation catalyst, the toner contains a metallic element derived from the polycondensation catalyst and the condensation catalyst in an amount of from 0 to 10 ppm, and the toner contains a sulfur component in an amount of from 100 to 20,000 ppm.

In the invention, the polycondensation resin and/or the condensation compound are preferably produced with a sulfur acid as a catalyst. The reaction for producing them is preferably carried out in an aqueous medium.

It is considered that this is because of the following factors. It is considered that a polycondensation or condensation reaction with a sulfur acid catalyst in an aqueous medium proceeds on the surface of particles. More specifically, the sulfur acid is preferably an acidic catalyst having a surfactant function, and in this case, the polycondensation or condensation reaction proceeds on the surface of oil droplets containing a polycondensation monomer or a raw material of the condensation compound formed in the aqueous medium. As a result, the surface of oil droplets of the polycondensation resin or the condensation compound thus produced has a slight amount of protons to form a slight electrostatic repulsive force between the releasing agent, between the binder resin, and between the releasing agent and the binder resin, whereby the dispersibility of the releasing agent and other additives in the binder resin can be improved. The mechanism can be favorably applied particularly to such a toner production method that contains a step of aggregating and integrating particles in an aqueous medium.

A binder resin particle dispersion liquid and a releasing agent particle dispersion liquid produced through polycondensation or condensation reaction in an aqueous medium can have uniform oil droplets according to the formulation and properties thereof, as being different from a dispersion liquid that is produced by emulsifying anew a polycondensation resin or a condensation compound having been produced in water. Accordingly, the oil droplets have a uniform diameter with an arrow particle diameter distribution, and hardly have deviation in formulation within each oil droplet. These points also contribute to the uniformity of the toner, the uniformity of the releasing agent, and the dispersion uniformity of various kinds of internal additives for the toner, and therefore, the polycondensation resin and the condensation compound are preferably obtained through polycondensation or condensation reaction in an aqueous medium.

In the invention, the amount of a metallic element derived from the polycondensation catalyst and the condensation catalyst in the toner is from 0 to 10 ppm, preferably 7.5 ppm or less, and more preferably 5.0 ppm or less.

In the conventional production method of a polycondensation resin and a condensation compound, the polycondensation reaction has been carried out by using a metallic catalyst. The amount of a metallic element derived from the catalyst remaining in the toner for developing an electrostatic image is 10 ppm or less using no metallic catalyst, whereby background fogging on an image occurring in the case where the toner is used at a high temperature and a high humidity can be eliminated, and coloration and formation of by-products ascribable to polycondensation at a high temperature can also be suppressed.

The metallic element derived from the polycondensation catalyst and the condensation catalyst in the toner of the invention includes a group of elements contained in the metallic catalysts described later, and designates, for example, tin, titanium, antimony, beryllium, strontium, germanium and a rare earth metal. In the invention, the total amount of the group of metallic elements is from 0 to 10 ppm, preferably 7.5 ppm or less, and more preferably 5.0 ppm or less.

The amount of a metallic element derived from the catalyst can be measured with a fluorescent X-ray analytical equipment. In the case where any one of the group of metallic elements is contained in the invention, the metallic element is adjudged as a metallic element derived from the polycondensation catalyst and/or the condensation catalyst.

In the invention, the amount of a sulfur component in the toner is from 100 to 20,000 ppm, preferably from 200 to 15,000 ppm, and more preferably from 200 to 10,000 ppm.

The sulfur component in the toner of the invention means an amount of sulfur element in the toner. The sulfur component in the toner is preferably a sulfur component derived from the catalyst, and in the case where the amount of the sulfur component is less than 100 ppm, the polycondensation reaction and the condensation reaction cannot proceed sufficiently. In the case where the amount of the sulfur component exceeds 20,000 ppm, there may be such a case where deterioration in charging property and odor upon fixing occur due to a compound containing sulfur element remaining in the toner.

The amount of a sulfur component can be measured in the manner described later, specifically elemental analysis, such as fluorescent X-ray analysis, of the toner.

(Binder Resin)

The toner for developing an electrostatic image of the invention contains a binder resin, and the binder resin contains a polycondensation resin obtained by polycondensing a polycondensation monomer in the presence of a polycondensation catalyst.

In the invention, the binder resin contains the polycondensation resin in an amount of 40% by weight or more, more preferably from 50 to 95% by weight, and further preferably from 60 to 95% by weight. In the case where the content of the polycondensation resin is in the range, it is preferred since the so-called low temperature fixing property and sharp melting property of the polycondensation resin can be imparted to the toner, and the releasing agent, a colorant and the like can maintain a favorable dispersed state.

In the invention, the binder resin preferably contains a noncrystalline resin in an amount of from 1 to 90% by weight, more preferably from 10 to 80% by weight, and further preferably from 20 to 75% by weight.

In the case where the content of the noncrystalline resin is in the range, it is preferred since the toner can have a sufficient strength at ordinary temperature and can be imparted with a strength of an image.

A polycondensation resin may be used as the noncrystalline resin, but an addition polymerization resin may also used. The binder resin preferably contains a polycondensation resin as a crystalline resin, and an addition polymerization resin as a noncrystalline resin.

Examples of the polycondensation monomer used for polycondensation include a polybasic carboxylic acid, a polyol and a polyamine. Examples of the polycondensation resin include polyester and polyamide, and polyester obtained by using a polycondensation monomer containing a polybasic carboxylic acid and a polyol is particularly preferred.

In the invention, the polybasic carboxylic acid includes aliphatic, alicyclic and aromatic polybasic carboxylic acids, and an alkyl ester thereof, and the polyol includes a polyhydric alcohol, an ester compound thereof and a hydroxycarboxylic acid. The polyester resin and the polyamide resin can be produced through polycondensation using a polycondensation monomer by a direct esterification reaction or an ester exchange reaction.

The polybasic carboxylic acid used as a monomer for polycondensation is a compound having two or more carboxylic groups in one molecule. Among the compounds, a dicarboxylic acid is a compound having two carboxyl groups in one molecule, and examples thereof include oxalic acid, succinic acid, adipic acid, glutaric acid, β-methyladipic acid, azelaic acid, sebacic acid, suberic acid, nonanedicarboxylic acid, decanedicarboxylic acid, undecanedicarboxylic acid, dedecanedicarboxylic acid, fumaric acid, citraconic acid, diglycollic acid, glutaconic acid, n-dodecylsuccinic acid, n-dodecenylsuccinic acid, isododecylsuccinic acid, isododecenylsuccinic acid, n-octylsuccinic acid, cyclohexanedicarboxylic acid, cyclohexan-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycollic acid, p-phenylenediglycollic acid, o-phenylenediglycollic acid, diphenyl-p,p'-dicarboxylic acid, naphthalene-1,4-dicarboxylic acid, naphthalene-1,5-dicarboxylic acid, naphthalene-2,6-dicarboyxlic acid and anthracene dicarboxylic acid. Examples of the polybasic carboxylic acid other than a dicarboxylic acid include trimellitic acid, pyromellitic acid, naphthalenetricarboxylic acid, naphthalenetetracarboxylic acid, pyrenetricarboxylic, acid and pyrenetetracarboxylic acid.

Among the aforementioned polybasic carboxylic acids, azelaic acid, sebacic acid, 1,9-nonanedicarboxylic acid, 1,10-decamethylenedicarboxylic acid, 1,11-undecanedicarboxylic acid, 1,12-dodecanedicarboxylic acid, terephthalic acid, trimellitic acid and pyromellitic acid are preferably used in the production method of polyester according to the invention. These polybasic carboxylic acids are preferred since they are hardly soluble or insoluble in water, and thus the ester synthesis reaction proceeds in a suspension liquid having the polybasic carboxylic acid dispersed in water.

The polyol used as a monomer for polycondensation is a compound having two or more hydroxyl groups in one molecule. Among the compounds, a diol is a compound having two hydroxyl groups in one molecule, and examples thereof include ethylene glycol, propylene glycol, butanediol, butenediol, neipentyl glycol, pentanediol, hexanediol, cyclohexanediol, cyclohexanedimethanol, diethylene glycol, triethylene glycol, dipropylene glycol, octanediol, decanediol, dodecanediol, polyethylene glycol, polypropylene glycol, polytetramethylene glycol, bisphenol A, bisphenol Z and hydrogenated bisphenol A. Examples of the polyol other than a diol include glycerin, pentaerythritol, hexamethylamelamine, hexaethylolmelamine, tetramethylolbenzoguanamine and tetraethylolbenzoguanamine.

Among the aforementioned polyols, such a diol as 1,8-octanediol, 1,10-decanediol and 1,12-dodecane diol is preferably used in the production method of polyester according to the invention. These polyols are preferred since they are hardly soluble or insoluble in water, and thus the ester synthesis reaction proceeds in a suspension liquid having the polyol dispersed in water.

Examples of the polyamine for obtaining polyamide include ethylene diamine, diethylene diamine, 1,2-propane diamine, 1,3-propane diamine, 1,4-butane diamine, 1,4-butene diamine, 2,2-dimethyl-1,3-butane diamine, 1,5-pentane diamine, 1,6-hexane diamine, 1,4-cyclohexane diamine and 1,4-cyclohexane-bis(methylamine).

A noncrystalline resin and a crystalline resin can be easily obtained with combinations of these polycondensation monomers.

Examples of the polybasic carboxylic acid used for obtaining crystalline polyester among the aforementioned carboxylic acids include an aliphatic dicarboxylic acid, such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,12-dodecanedicarboxylic acid, 1,14-tetradecanedicarboxylic acid and 1,18-octadecanedicarboxylic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and an anhydride and a chloride thereof. The polybasic carboxylic acid of higher than a dibasic acid described later may also be used in combination.

Examples of the diol used for obtaining crystalline polyester include ethylene glycol, diethylene glycol, triethylene glycol, 1,2-propylene glycol, 1,3-propylene glycol, 1,4-butanediol, 1,4-butenediol, neopentyl glycol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanediol, polyethylene glycol, polypropylene glycol, polytetramethylene ether glycol, 1,4-cyclohexanediol, 1,4-cyclohexanedimethanol, dipropylene glycol, polyethylene glycol, polypropylene glycol, polytetramethylene glycol, bisphenol A, bisphenol Z, bisphenol C, bisphenol E, bisphenol F, bisphenol P, bisphenol S, bisphenol, napthalenediol, adamantanediol, adamantanedimethanol and hydrogenated bisphenol A. A polyhydric alcohol of higher than a diol may be used in combination. Examples thereof include glycol, pentaerythritol, hexamethyloamine, hexaethylolamine, tetramethylolbenzoguanamine and tetraethylolbenzoguanamine.

The aforementioned bisphenol compound preferably has at least one alkylene oxide group. Examples of the alkylene oxide group include an ethylene oxide group, a propylene oxide group and a butylene oxide group, but the alkylene oxide group is not limited thereto. An ethylene oxide group and a propylene oxide group are preferred, and the addition molar number thereof is preferably from 1 to 3. In the case where the addition molar number is in the range, the polyester produced can be optimally controlled in viscoelasticity and glass transition temperature for use as a toner.

Examples of the crystalline polycondensation resin include polyester obtained by reacting 1,9-nonanediol with 1,10-decanedicarboxylic acid, or reacting cyclohexanediol with adipic acid, polyester obtained by reacting 1,9-nonanediol with sebacic acid, polyester obtained by reacting 1,6-hexanediol with sebacic acid, polyester obtained by reacting ethylene glycol with succinic acid, polyester obtained by reacting ethylene glycol with sebacic acid, and polyester obtained by reacting 1,4-butanediol with succinic acid. Among these, polyester obtained by reacting 1,9-nonanediol with 1,10-decanedicarboxylic acid, polyester obtained by reacting 1,9-nonanediol with sebacic acid, and polyester obtained by reacting 1,6-hexanediol with sebacic acid are more preferred.

Examples of the polybasic carboxylic acid used for obtaining noncrystalline polyester in the invention among the aforementioned carboxylic acids include a dicarboxylic acid, such as phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycollic acid, p-phenylenediglycollic acid, o-phenylenediglycollic acid, diphenylacetic acid, diphenyl-p,p'-dicarboxylic acid, naphthalene-1,4-dicarboxylic acid, naphthalene-1,5-dicarboxylic acid, naphthalene-2,6-dicarboyxlic acid, naphthalene-1,5-dicarboxylic acid, anthracene dicarboxylic acid, cyclohexanedicarboxylic acid, cyclohexenedicarboxylic acid, norbornene-2,3-dicarboxylic acid, adamantanedicarboxylic acid and adamantanediacetic acid. Examples of the polybasic carboxylic acid other than a dicarboxylic acid include trimellitic acid, pyromellitic acid, naphthalenetricarboxylic acid, naphthalenetetracarboxylic acid, pyrenetricarboxylic, acid and pyrenetetracarboxylic acid. A compound obtained by deriving the carboxyl group of the carboxylic acid to an acid anhydride, an acid chloride or an ester may also be used.

Among these, terephthalic acid and a lower ester thereof, diphenylacetic acid and cyclohexanedicarboxylic acid are preferably used. The lower ester referred herein means an ester of an aliphatic alcohol having from 1 to 8 carbon atoms.

Preferred examples of the polyol used for obtaining noncrystalline polyester in the invention among the polyols include polytetramethylene glycol, bisphenol A, bisphenol Z, bisphenol S, bisphenol, naphthalenediol, adamantanediol, adamantanedimethanol, hydrogenated bisphenol A and cyclohexanedimethanol.

The polybasic carboxylic acids and the polyols may be used singly, respectively, for producing one kind of the polycondensation resin, or one kind for one and two or more kinds for the other, or two or more kinds for each may be used for producing one kind of the polycondensation resin. In the case where a hydroxycarboxylic acid is used for producing one kind of the polycondensation resin, the hydroxycarboxylic acid may be used singly or in combination of two more kinds thereof, and a polybasic carboxylic acid and a polyol may be used in combination.

In the case where crystalline polyester is used as the polycondensation resin in the invention, the crystal melting temperature Tm thereof is preferably from 50 to 120° C., and more preferably from 55 to 90° C. In the case where the melting temperature Tm is 50° C. or more, it is preferred since the releasing property is improved to reduce offset. In the case where the melting temperature Tm is 120° C. or less, it is preferred since an image can be fixed at a lower temperature.

The melting temperature of the crystalline polyester resin can be measured with a differential scanning calorimeter (DSC) and can be obtained as a melting peak temperature in the input compensation differential scanning calorimetry defined in JIS K7121:87 upon measuring at a temperature increasing rate of 10° C. per minute from room temperature to 150° C. The crystalline polyester resin may exhibits plural melting peaks in some cases, and in the invention, the maximum peak is designated as the melting temperature.

In the case where a noncrystalline polyester resin is used as the polycondensation resin, the glass transition temperature Tg of the noncrystalline polyester is preferably from 40 to 100° C., and more preferably from 50 to 80° C. In the case where the glass transition temperature Tg is in the range, it is preferred since hot offset property upon fixing hardly occurs owing to the good cohesion force of the binder resin itself in a high temperature range, and sufficient melting is obtained to suppress the minimum fixing temperature from being increased.

The glass transition temperature of the noncrystalline resin is a value measured by the method defined in ASTM D3418-82 (DSC method).

The glass transition temperature in the invention can be measured, for example, by the differential scanning calorimetry (DSC) by using DSC-20 (produced by Seiko Instruments Inc.). Specifically, about 10 mg of a specimen is heated at a constant temperature increasing rate (10° C. per minute), and the glass transition temperature can be obtained from an intersecting point of the base line and the inclined line of the endothermic peak.

In the case where a crystalline polyester resin is used as the polycondensation resin in the invention, the resin preferably has a weight average molecular weight of from 1,000 to 60,000 measured by the gel permeation chromatography (GPC) molecular weight measuring method of a component soluble in tetrahydrofuran (THF), more preferably from 1,500 to 50,000, and further preferably from 2,000 to 40,000.

In the case where a noncrystalline polyester resin is used as the polycondensation resin in the invention, the resin preferably has a weight average molecular weight of from 1,000 to 60,000 measured by the GPC molecular weight measuring method of a component soluble in THF, more preferably from 3,000 to 50,000, and further preferably from 5,000 to 40,000.

In the case where the weight average molecular weight is in the range, it is preferred since the anti-offset property is improved.

The molecular weight of the resin in the invention can be measured in such a manner that the component soluble in THF is measured with THF as a solvent by using TSK-GEL GMH (produced by Tosoh Corp.), and the molecular weight is calculated by using a molecular weight calibration line produced with the monodisperse polystyrene standard samples.

In the invention, either both the noncrystalline polyester resin and the crystalline polyester resin may be used as the polycondensation resin, and at least the crystalline polyester resin is preferably used.

The term "crystalline" referred in the crystalline polyester resin means that the resin exhibits a distinct endothermic peak but not stepwise endothermic change, and specifically, means that an endothermic peak measured at a temperature increasing rate of 10° per minute has a half value width of 15° C. or less. A resin having a half value width of an endothermic peak exceeding 15° C. and a resin having no distinct endothermic peak are designated as a noncrystalline (amorphous) resin.

The use of the crystalline polyester as the polycondensation resin is preferred since both the image quality and the low temperature fixing property, which are the characteristic features of polyester, can be simultaneously obtained.

In the invention, the polycondensation step may be carried out by polymerization reaction of the polycarboxylic acid and the polyol as having been described as the polycondensation components with a prepolymer produced in advance. The prepolymer is not limited as far as it is such a polymer that can be fused or uniformly mixed with the aforementioned monomers.

In the invention, furthermore, the binder resin may be a homopolymer of the polycondensation components, a copolymer obtained by combining two or more kinds of monomers including the polymerization components, or a mixture or a graft polymer thereof, and may have a partial branched structure or a crosslinked structure.

The polycondensation resin in the invention is a resin obtained by polycondensation of the polycondensation monomer in the presence of a polycondensation catalyst. In the invention, the polycondensation catalyst preferably contains a sulfur acid.

(Sulfur Acid)

The sulfur acid includes an inorganic sulfur acid and an organic sulfur acid. Examples of the inorganic sulfur acid include sulfuric acid, sulfurous acid, and a salt thereof, and examples of the organic sulfur acid include a sulfonic acid compound, such as an alkylsulfonic acid, an arylsulfonic acid, and a salt thereof, and an organic sulfuric acid compound, such as an alkylsulfuric acid, an arylsulfuric acid, and a salt thereof.

The sulfur acid is preferably an organic sulfur acid, and more preferably an organic sulfur acid having a surfactant function. The acid having a surfactant function referred herein means such a compound that has a chemical structure containing a hydrophobic group and a hydrophilic group, and at least a part of the hydrophilic group has an acid structure containing a proton, so as to exhibit both an emulsifying function and a catalytic function.

Examples of the organic sulfur acid having a surfactant function include an alkylbenzenesulfonic acid, an alkylsulfonic acid, an alkyldisulfonic acid, an alkylphenolsulfonic acid, an alkylnaphthalenesulfonic acid, an alkyltetralinsulfonic acid, an alkylallylsulfonic acid, a petroleum sulfonic acid, an alkylbenzoimidazolesulfonic acid, a higher alcohol ethersulfonic acid, an alkyldiphenylsulfonic acid, a long-chain alkyl sulfate ester, a higher alcohol sulfate ester, a higher alcohol ether sulfate ester, a high fatty acidamide alkylol sulfate ester, a higher fatty acidamide alkylated sulfate ester, a sulfated fat, a sulfosuccinate ester, a resin acid alcohol sulfuric acid, and salt compounds of these compounds, which may be used in combination of plural kinds thereof depending on necessity. Among these, a sulfonic acid having an alkyl group or an aralkyl group, a sulfate ester having an alkyl group or an aralkyl group, or salt compounds of these compounds are preferred, and more preferably the alkyl group or the aralkyl group has from 7 to 20 carbon atoms. Specific examples thereof include dodecylbenzene sulfonate, pentadecylbenzene sulfonate, isopropylbenzene sulfonate, camphor sulfonate, p-toluenesulfonic acid, monobutylphenylphenolsulfonic acid, dibutylphenylphenolsulfonic acid, dodecyl sulfate and naphthenyl alcohol sulfuric acid. These sulfur acids may have a certain kind of a functional group in the structure thereof.

The amount of the sulfur acid used in the invention is preferably from 0.5 to 40% by weight, and more preferably from 1 to 20% by weight, based on the total weight of the polycondensation monomer.

In the case where the using amount of the sulfur acid is in the range, it is preferred since the particles maintain stability in water and have higher polycondensation reactivity, and the charging property of the toner can be suitably maintained.

Another polycondensation catalyst that is ordinarily used may be employed solely or in addition to the sulfur acid catalyst. Specific examples thereof include an acid having a surfactant function, a metallic catalyst, a hydrolyzing enzyme catalyst and a basic catalyst.

(Acid Having Surfactant Function)

Examples of the acid having a surfactant function include various kinds of fatty acids, a higher alkylphosphate ester, resin acid, and salt compounds of these compounds, which may be used in combination of plural kinds thereof.

(Metallic Catalyst)

Examples of the metallic catalyst include the following, but the invention is not limited thereto. Examples thereof include an organic tin compound, an organic titanium compound, an organic antimony compound, an organic beryllium compound, an organic strontium compound, an organic germanium compound, an organic halogenated tin compound and a rare earth metallic catalyst.

Effective examples of the rare earth element-containing catalyst include those containing such an element as scandium (Sc), yttrium (Y), a lanthanoid element, such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) and lutetium (Lu). Those having an alkylbenzenesulfonate salt, an alkylsulfate ester salt or a triflate structure are particularly effective, and examples of the triflate include $X(OSO_2CF_3)_3$ in terms of structural formula, wherein X represents a rare earth element, and more preferably scandium (Sc), yttrium (Y), ytterbium (Yb) or samarium (Sm).

The lanthanoid triflate is described in detail in *J. Syn. Org. Chem., Japan*, vol. 53, No. 5, pp. 44-54 (1995).

In the case where the metallic catalyst is used as the catalyst, the content of a metal derived from the catalyst in the resulting resin is 10 ppm or less, preferably 7.5 ppm or less, and more preferably 5.0 ppm or less. Accordingly, it is preferred that the metallic catalyst is not used, or even though it is used, the amount thereof is preferably small.

(Hydrolyzing Enzyme Catalyst)

The hydrolyzing enzyme catalyst is not particularly limited as far as it has a catalytic action on an ester synthesis reaction. Examples of the hydrolyzing enzyme catalyst in the invention include an esterase classified into EC 3.1 group (see Maruo and Tamiya, *Koso Handbook* (Enzyme Handbook), published by Asakura Shoten Co., Ltd. (1982)), such as carboxyesterase, lipase, phospholipase, acetylesterase, pectinesterase, cholesterolesterase, tannase, monoacylglycerollipase, lactonase and lipoproteinlipase, a hydrolyzing enzyme classified into EC 3.2 group acting on a glycosyl compound, such as glucosidase, galactosidase, glucuronidase and xylosidase, a hydrolyzing enzyme classified into EC 3.3 group, such as epoxyhydrase, a hydrolyzing enzyme classified into EC 3.4 group acting on a peptide bond, such as aminopeptidase, chymotrypsin, trypsin, plasmin and subtilisin, and a hydrolyzing enzyme classified into EC 3.7 group, such as phloretinhydrase.

An esterase that hydrolyzes a glycerol ester to form a free fatty acid is referred to as a lipase, which has such an advantage that it has high stability in an organic solvent, catalyzes an ester synthesis reaction with a high yield, and is available at low cost. Accordingly, a lipase is preferably used in the production method of the invention from the standpoint of yield and cost.

A lipase of various origins may be used, and preferred examples thereof include a lipase obtained from a microorganism, such as those belonging to the genera *Pseudomonas, Alcaligenes, Achromobacter, Candida, Aspergillus, Rhizopus* and *Mucor*, a lipase obtained from vegetable seeds, a lipase obtained from an animal tissues, and pancreatin and steapsin. Among these, a lipase obtained from a microorganism belonging to the genera *Pseudomonas, Candida* and *Aspergillus* is preferably used.

(Basic Catalyst)

Examples of the basic catalyst include an ordinary organic basic compound, a nitrogen-containing basic compound, and a tetraalkyl or arylphosphonium hydroxide, such as tetrabutylphosphonium hydroxide, but the invention is not limited thereto. Examples of the organic basic compound include an ammonium hydroxide compound, such as tetramethylammonium hydroxide and tetraethylammonium hydroxide, and examples of the nitrogen-containing basic compound include an amine compound, such as triethylamine benzylmethylamine, pyridine, methylpyridine, methoxypyridine, quinoline, imidazole, a hydroxide, a hydride and an amide of an alkali metal, such as sodium, potassium, lithium and cesium, or an alkaline earth metal, such as calcium, magnesium and barium, and a salt of an acid with an alkali metal or an alkaline earth metal, such as a carbonate, a phosphate, a borate, a carboxylate and a salt with phenolic hydroxyl group.

Examples thereof also include a compound with an alcoholic hydroxyl group and a chelate compound with acetylacetone, but the invention is not limited thereto.

The total addition amount of the catalyst is preferably from 0.5 to 40% by weight, and more preferably from 1 to 30% by weight, based on the total amount of the polycondensation component. The catalyst may be added solely or in combination of plural kinds thereof in an amount in the aforementioned range.

In the case where the total addition amount of the catalyst is in the range, it is preferred since sufficiently polycondensation reactivity can be obtained, and a reverse reaction and a side reaction can be suppressed.

In the invention, the binder resin can be obtained even when the polycondensation reaction is carried out at a temperature that is lower than the ordinary reaction temperature. The reaction temperature in the invention is preferably from 70 to 150° C., and more preferably from 70 to 130° C.

In the case where the reaction temperature is 70° C. or more, it is preferred since reduction in reactivity due to reduction in solubility of the monomers and activity of the catalyst can be eliminated, and the molecular weight is not suppressed from being increased. In the case where the reaction temperature is 150° C. or less, it is preferred since the resin can be produced with a small amount of energy, and it is also preferred since coloration of the resulting resin and decomposition of the polycondensation resin can be prevented from occurring.

In order to reduce the production energy of the resin and the production energy of the toner in total, it is particularly important to avoid the conventional high energy consumption production method but to produce a polycondensation resin at a low temperature of 150° C. or less. While the polycondensation reaction has been conventionally carried out at a high temperature exceeding 200° C., it is suitable to use a sulfur acid catalyst for carrying out the polycondensation reaction at a low temperature of 150° C. or less, which is lower than the conventional method by from several tens to a hundred and several tens degrees Celsius. This is because the conventional metallic catalyst, such as an Sn series and a Ti series, has high catalytic activity at a temperature of 200° C. or more but is considerably low in activity at a low temperature of 150° C. or less.

A sulfur acid has catalytic activity gradually decreased with increase of temperature in a high temperature range of 160° C. or more, but has high catalytic activity in a low temperature range of about from 70 to 150° C. owing to the reaction mechanism where the reaction proceeds with nucleophilic addition of the catalytic acid as trigger, and therefore, it can be favorably applied to the polycondensation reaction at a temperature of 150° C. or less.

The resin produced by using the sulfur acid catalyst is excellent in mechanical strength as compared to the resin produced by using the metallic catalyst. The polymerization with the sulfur acid catalyst proceeds through the nucleophilic addition reaction mechanism, and thus the probability of inclusion of impurities is low. The resin produced by using the metallic catalyst, such as the Sn series and the Ti series, is produced through such a reaction mechanism that an acid and an alcohol are gathered on the surface of the metallic catalyst, and thus the catalyst metal is liable to be incorporated in the resin. When a metal having conductivity is incorporated in a resin, the charge of the resin is liable to leak. In the case of such a resin is used in a toner, charge leakage is liable to occur particularly upon printing at a high temperature and a high humidity, to lower the charge amount, which brings about such problems as background fogging due to scattering of the toner over the non-image part.

In the case where the sulfur acid catalyst is used, however, inclusion of a metallic element can be suppressed from occurring, and thus it is preferred since charge leakage hardly occur even under a high temperature and high humidity condition to prevent background fogging from occurring. Accordingly, the sulfur acid catalyst is preferably used as compared to the metallic catalyst.

The polycondensation reaction may be carried out by an ordinary polycondensation method, such as bulk polymerization, emulsion polymerization, polymerization in water, such as suspension polymerization, and interface polymerization, and polymerization in water is generally employed.

Bulk polymerization can be carried out under the atmospheric pressure, but in order to increase the molecular weight of polyester molecules thus obtained, ordinary conditions, such as reduced pressure and nitrogen stream, may be employed.

Among these, it is preferred that the polycondensation resin is obtained by directly polycondensing the polycondensation monomer in an aqueous medium.

The aqueous medium in the invention means water or a mixed solvent containing water in an amount of 50% by weight or more, to which a water miscible organic solvent may be mixed. The mixing ratio of water in the mixed solvent is preferably from 60 to 100% by weight, and more preferably from 70 to 100% by weight. Examples of the water miscible organic solvent include ethyl alcohol, methyl alcohol, acetone and acetic acid, and ethyl alcohol is preferably used. The aqueous medium is most preferably water, and soft water and ion exchanged water are particularly preferred. The solvents may be used solely or in combination of two or more kinds thereof.

In order to obtain the polycondensation resin particles having a prescribed particle diameter in the aqueous medium, it is suitable to employ, as the polymerization method, an ordinary heterogeneous polymerization system with an aqueous medium, examples of which include a suspension polymerization method, a dissolution suspension method, and an emulsion polymerization method, such as a minute emulsion method, a microemulsion method, a multistage swelling method and a seed polymerization method. In this case, the parameters of polycondensation reaction, particularly the final molecular weight and the polymerization rate, depend on the final particle diameter of the particles, and therefore, in order to produce efficiently particles having a diameter of 1 μm, which is the most preferred particle diameter, such a polymerization method is preferred that submicron particles having a diameter of 1 μm or less are finally obtained, such as a minute emulsion method and a microemulsion method.

Upon obtaining the polycondensation resin particles by polycondensation in the aqueous medium, the materials are emulsified or dispersed in the aqueous medium, for example, with a mechanical shearing force or an ultrasonic vibration, and upon emulsification and dispersion, a surfactant, a polymer dispersant and an inorganic dispersant may be added to the aqueous medium.

Examples of the surfactant used herein include an anionic surfactant, such as a sulfate series, a sulfonate series and a phosphonate series; a cationic surfactant, such as an amine salt series and a quaternary ammonium salt series; and a nonionic surfactant, such as a polyethylene glycol series, an alkylphenol ethylene oxide adduct series and a polyhydric alcohol series. Among these, an anionic surfactant and a cationic surfactant are preferably used. The nonionic surfactant is preferably used in combination with the anionic surfactant or the cationic surfactant. The surfactants may be used solely or in combination of two or more kinds thereof. Examples of the anionic surfactant include sodium dodecylbenzenesulfonate, sodium alkylnaphthalenesulfonate, sodium arylalkylpolyethersulfonate, sodium 3,3-disulfonediphenylurea-4,4-diazo-bis-amino-8-naphthol-6-sulfonate, o-carboxybenzene-azo-dimethylanilyne, sodium 2,2,5,5-tetramethyl-triphenylmethane-4,4-diazo-bis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate and calcium oleate. Examples of the cationic surfactant include alkylbenzenedimethylammonium chloride, alkyltrimethylammonium chloride and distearylammonium chloride. Examples of the nonionic surfactant include polyethylene oxide, polypropylene oxide, a combination of polypropylene oxide and polyethylene oxide, an ester of polyethylene oxide and a higher fatty acid, alkylphenolpolyethylene oxide, an ester of a higher fatty acid and polyethylene glycol, an ester of a higher fatty acid and polypropylene oxide, and a sorbitan ester. Examples of the polymer dispersant include sodium polycarboxylate and polyvinyl alcohol, and examples of the inorganic dispersant include calcium carbonate, but the invention is not limited to these compounds. In order to prevent the Ostwald Ripening phenomenon of monomer emulsion particles in the aqueous medium from occurring, a higher alcohol, such as heptanol and octanol, and a higher aliphatic hydrocarbon, such as hexadecane, may be added as a stabilizer assistant.

In the polycondensation of the polycondensation resin particles in the aqueous medium, a colorant, a fixing assistant, such as wax, and another charging assailant may be mixed in the aqueous medium in advance to incorporate them into the polycondensation resin particles upon polycondensation.

In the invention, the polycondensation reaction may be carried out in the presence of an addition polymerizable monomer, and the addition polymerizable monomer undergoes addition polymerization finally to provide composite particles containing the polycondensation resin and an addition polymerization polymer.

Examples of the addition polymerizable monomer that can be used in the invention include a radical polymerization monomer, a cationic polymerization monomer and an anionic polymerization monomer, and a radical polymerization monomer is preferably used.

(Releasing Agent)

The releasing agent in the invention contains a condensation compound obtained by condensing a condensation monomer. The condensation compound preferably contains a metallic element in an amount of from 0 to 10 ppm and preferably contains a sulfur component derived from a condensation catalyst in an amount of from 100 to 20,000 ppm.

The releasing agent preferably contains the condensation compound in an amount of 2% by weight or more, more preferably from 2 to 100% by weight, and further preferably from 5 to 100% by weight. In the case where the content of the condensation compound is in the range, the advantage of the invention can be sufficiently exhibited to improve the releasing property and the image quality.

The condensation compound may be selected from such an range that satisfies the aforementioned characteristics, and the condensation compound is preferably obtained through condensation with a sulfur acid as a catalyst, and more preferably obtained through condensation in an aqueous medium with a sulfur acid as a catalyst.

In the invention, the condensation compound is preferably obtained by condensation reaction of an alcohol and a carboxylic acid in an aqueous medium with a sulfur acid as a catalyst. The sulfur acid may be the aforementioned compounds used for the polycondensation of the binder resin with the same preferred ranges.

The conditions for the condensation reaction may be the same as the polycondensation conditions of the polycondensation resin with the same preferred ranges.

Examples of the releasing agent that is preferred for the toner of the invention include a crystalline ester compound represented by the following general formula (1) (hereinafter, referred to as a specified ester compound):

$$R_1—(OCO—R_2)_n \quad (1)$$

wherein $R_1$ and $R_2$ each represents a hydrocarbon group, which may have a substituent, and n represents an integer of 1 or more.

In the general formula (1) representing the specified ester compound, $R_1$ and $R_2$ each represents a hydrocarbon group, which may have a substituent. The hydrocarbon group $R_1$ preferably has from 1 to 40 carbon atoms, more preferably from 5 to 30 carbon atoms, and further preferably from 8 to 28 carbon atoms. The hydrocarbon group $R_2$ preferably has from 1 to 40 carbon atoms, more preferably from 16 to 30 carbon atoms, and further preferably from 18 to 26 carbon atoms. In the general formula (1), n is an integer of 1 or more, preferably from 1 t 6, and further preferably from 1 to 4. The specified ester compound can be favorably synthesized by dehydration condensation reaction of an alcohol and a carboxylic acid.

As the carboxylic acid constituting the specified ester compound, linear saturated monocarboxylic acids selected from those having from 14 to 30 carbon atoms and having one component in an amount of 60% by weight or more is preferably used. As the alcohol constituting the specified ester compound, linear saturated monohydric alcohols selected from those having from 14 to 30 carbon atoms and having one component in an amount of 60% by weight or more, or polyhydric alcohols having a valency of from 2 to 6 selected from those having from 2 to 30 carbon atoms and having one component in an amount of 80% by weight or more may also be used.

Examples of the linear saturated monocarboxylic acid include myristic acid, palmitic acid, stearic acid, arachinic acid, behenic acid, lignoceric acid, cerinic acid, montanic acid and melissic acid.

Examples of the linear saturated monohydric alcohol include myristyl alcohol, cetyl alcohol, stearyl alcohol, aralkyl alcohol, behenyl alcohol, tetracosanol, hexacosanol, octacosanol and triacontanol.

Among the polyhydric alcohol having a valency of from 2 to 6, examples of a dihydric alcohol include ethylene glycol, propylene glycol, 1,3-propanediol, 1,4-propanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosandiol, 1,30-triacontanediol, diethylene glycol, dipropylene glycol, 2,2,4-trimethyl-1,3-pentanediol, neopentyl glycol, 1,4-cyclohexanediol, spiroglycol, 1,4-phenylene glycol, bisphenol A and hydrogenated bisphenol A, examples of the trihydric alcohol include 1,2,4-butanetriol, 1,2,5-pentanetriol, 2-methyl-1,2,4-butanetriol, glycerin, 2-methylpropanetriol, trimethylolethane, triethylolethane, trimethylolpropane and 1,3,5-trihydroxymethylbenzene, examples of the tetrahydric alcohol include 1,2,3,6-hexanetetrol and pentaerythritol, examples of the pentahydric alcohol include glucose, and examples of the hexahydric alcohol include dipentaerythritol.

The condensation compound preferably has crystalline property. The crystalline condensation compound is preferred since the releasing property from a fixing roll can be easily controlled.

The condensation compound preferably has a crystalline melting temperature of from 50 to 120° C., and more preferably from 50 to 100° C. In the case where the melting temperature is in the range, it is preferred since the releasing property from a fixing roll, the hot offset durability and the antiblocking property can be maintained.

In the invention, other components that are known as a releasing agent may be used in combination with the aforementioned condensation compound. Specific examples of the known releasing agent include olefin wax, such as low molecular weight polyethylene, low molecular weight polypropylene, copolymer polyethylene, graft polyethylene and graft polypropylene, ester wax having a long chain aliphatic group, such as behenyl behenate, a montanate ester, vegetable wax, such as hydrogenated ricinus and carnauba wax, a ketone having a long chain alkyl group, such as distearyl ketone, silicone wax having an alkyl group or a phenyl group, a higher fatty acid, such as stearic acid, a higher fatty amide, such as oleic amide and stearic amide, a long chain fatty acid alcohol, along chain fatty acid polyhydric alcohol, such as pentaerythritol, and a partially esterified product thereof, paraffin wax, and Fischer-Tropsch wax.

The releasing agent particle dispersion liquid preferably has a median diameter of 1 μm or less, and more preferably from 0.1 to 0.8 μm. In the case where the median diameter of the releasing agent particles is in the range, it is preferred since the aggregation property upon forming the particles and the particle size distribution of the toner can be easily controlled, and the releasing property upon fixing and the temperature, at which offset occurs, can be suitably maintained.

The amount of the releasing agent is preferably in a range of from 5 to 30% by weight, and more preferably from 5 to 25% by weight, based on the total weight of the solid contents constituting the toner. The range is preferred from the standpoint of ensuring the releasing property of a fixed image in an oilless fixing system.

(Production Method of Toner)

The method for producing a toner according to the invention preferably contains at least the steps of: aggregating resin particles in a dispersion liquid containing the resin particles and releasing agent particles (aggregating step); and fusing the aggregated particles by heating (fusing step). In the production method, which is referred to as an emulsion polymerization aggregation method, it is preferred that the binder resin particle dispersion liquid is applied to the dispersion liquid containing the resin particles dispersed therein, and the condensation compound particle dispersion liquid is applied to the releasing particle dispersion.

In the aggregating step, the resin particle dispersion liquid can be used as it is in the case where the polycondensation resin particles in the resin particle dispersion are prepared in an aqueous medium, and the resin particle dispersion liquid is mixed with a releasing agent particle dispersion and, depending on necessity, a colorant particle dispersion liquid, to which an aggregating agent is added, whereby the particles are heterogeneously aggregated to form aggregated particles having the toner diameter.

The resin particle dispersion liquid having the resin particles dispersed therein may be produced by an arbitrary method, such as a method of adding a polymer of resin particles obtained by uniformly polymerized by a solution polymerization method or a bulk polymerization method to a solvent that does not dissolve the polymer along with a stabilizer, followed by mechanically mixing and dispersing.

For example, a polymer that is dissolved in a solvent having a relatively low solubility in water may be dissolved in the solvent, and the solution is dispersed into particles in water with a dispersing apparatus, such as a homogenizer, along with an ionic surfactant or a polymer electrolyte, such as polyacrylic acid, followed by evaporating the solvent by heating or reducing pressure, so as to obtain a resin particle dispersion liquid.

Examples of the surfactant include an anionic surfactant, such as a sulfate series, a sulfonate series, a phosphonate series and a soap series; a nonionic surfactant, such as a polyethylene glycol series, an alkylphenol ethylene oxide adduct series and a polyhydric alcohol series; and various kinds of graft polymers, but the invention is not limited thereto.

It is preferred that the median diameters of the polycondensation resin particles and the condensation compound particles are controlled to a range of from $1/0.3$ to $1/3$.

In the case where the median diameters are controlled into the range, it is preferred since favorable electrostatic repulsive effect can be obtained owing to a small difference in surface area, which prevents the difference in amount of protons carried on the surfaces from being increased.

After forming the first aggregating particles in this manner, another resin particle dispersion liquid that is different from the aforementioned resin particle dispersion liquid of the invention may be added to form the second shell layer. In the exemplary embodiment described herein, the colorant particle dispersion liquid is separately prepared, but the colorant dispersion liquid may be omitted when the colorant has been mixed with the polycondensation resin particles in advance.

Preferred examples of the aggregating agent include, in addition to the surfactant, an inorganic salt and a salt of a metal having a valency of two or more. The use of a metallic salt is particularly preferred in such characteristics as control of the aggregating property and the charging property of the toner. A surfactant may be used for such purposes as emulsion polymerization of a resin, dispersion of a pigment, dispersion of resin particles, dispersion of a releasing agent, aggregation, and stabilization of aggregated particles. Specific examples thereof include an anionic surfactant, such as a sulfate series, a sulfonate series, a phosphonate series and a soap series; a cationic surfactant, such as an amine salt series and a quaternary ammonium salt series; and a nonionic surfactant, such as a polyethylene glycol series, an alkylphenol ethylene oxide adduct series and a polyhydric alcohol series, which may be effectively used in combination. Examples of the dispersing device include devices ordinarily used, such as a rotation shearing homogenizer and a device using a medium, e.g., a ball mill, a sand mill and a Dinor mill.

In addition to the aforementioned polycondensation resin particle dispersion liquid, an addition polymerization resin particle dispersion liquid produced, for example, by emulsion polymerization having been known may also be used in combination.

Examples of the addition polymerization polymer for producing the resin particle dispersion liquid include homopolymers and copolymers of a vinyl monomer, example of which include a styrene compound, such as styrene and p-chlorostyrene, vinylnaphthalene, vinyl chloride, vinyl bromide, vinyl fluoride, a vinyl ester compound, such as vinyl acetate, vinyl propionate, vinyl benzoate and vinylbutyrate, a methylene aliphatic carboxylate ester, such as methyl acrylate, ethyl acrylate, n-butyl acrylate, isobutyl acrylate, dodecyl acrylate, n-octyl acrylate, 2-chloroethyl acrylate, phenyl acrylate, methyl $\alpha$-chloroacrylate, methyl methacrylate, ethyl methacrylate and butyl methacrylate, acrylonitrile, methacrylonitrile, acrylamide, a vinyl ether compound, such as vinyl methyl ether, vinyl ethyl ether and vinyl isobutyl ether, a monomer having a nitrogen-containing polar group, e.g., an N-vinyl compound including N-vinylpyrrole, N-vinylcarbazole, N-vinylindole and N-vinylpyrrolidone, and a vinyl carboxylic acid, such as methacrylic acid, acrylic acid, cinnamic acid and carboxyethyl acrylate, and various kinds of wax may also be used in combination.

In the case of an addition polymerization monomer, the resin particle dispersion liquid can be produced by carrying out emulsion polymerization by using an ionic surfactant. In the case of other resins, a resin that is dissolved in a solvent having a relatively low solubility in water may be dissolved in the solvent, and the solution is dispersed into particles in water with a dispersing apparatus, such as a homogenizer, along with an ionic surfactant or a polymer electrolyte, followed by evaporating the solvent by heating or reducing pressure, so as to obtain a resin particle dispersion liquid.

After the aggregating step, the dispersion liquid is heated to a temperature that is equal to or higher than the glass transition temperature or the melting temperature of the resin particles, whereby the aggregated particles are fused and integrated and then washed and dried depending on necessity, to obtain a toner.

After completing the fusing step, the intended toner particles are obtained through a washing step, a solid-liquid separating step and a drying step, which are arbitrarily carried out, and taking the charging property into consideration, the washing step is preferably carried out by replacement washing with ion exchanged water. The solid-liquid separating step is not particularly limited, and suction filtration or pressurization filtration is preferred from the standpoint of productivity. The drying step is not particularly limited, and freeze drying, flash jet drying, fluidized drying and vibration fluidized drying are preferably employed from the standpoint of productivity.

The constitution components of the toner (i.e., the raw materials used in the production method) will be described.

Examples of the colorant that can be used in the invention include the following pigments and dyes. Examples of a black pigment include carbon black, copper oxide, manganese dioxide, aniline black, non-magnetic ferrite and magnetite.

Examples of a yellow pigment include chrome yellow, zinc yellow, yellow iron oxide, cadmium yellow, chrome yellow, Hansa Yellow, Hansa Yellow 10G, Benzidine Yellow G, Benzidine Yellow GR, Threne Yellow, Quinoline Yellow and Permanent Yellow NCG.

Examples of an orange pigment include red chrome yellow, molybdenum orange, Permanent Orange GTR, Pyrazolone Orange, Vulcan Orange, Benzidine Orange G, Indanthrene Brilliant Orange RK and Indanthrene Brilliant Orange GK.

Examples of a red pigment include red iron oxide, cadmium red, red lead oxide, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosin Red and Alizarine Lake.

Examples of a blue pigment include iron blue, cobalt blue, Alkali Blue Lake, Victora Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate.

Examples of a violet pigment include manganese violet, Fast Violet B and Methyl Violet Lake.

Examples of a green pigment include chromium oxide, chromium green, Pigment Green, Malachite Green Lake and Final Yellow Green G.

Examples of a white pigment include zinc flower, titanium oxide, antimony white and zinc sulfide.

Examples of a body pigment include barite powder, barium carbonate, clay, silica, white carbon, talc and alumina white.

Examples of a dye include various kinds of basic, acidic, dispersion and direct dyes, such as nigrosine, methylene blue, rose bengal, quinoline yellow and ultramarine blue.

The colorant may be used solely or as a mixture thereof. The colorant particle dispersion liquid may be prepared by dispersing the colorant with a dispersing apparatus, such as a rotation shearing homogenizer, a device using a medium, e.g., a ball mill, a sand mill and an attritor, and a high pressure counter collision dispersing apparatus. The colorant may be dispersed in an aqueous medium by using a homogenizer along with a surfactant having polarity.

The colorant is selected from the standpoint of hue angle, chroma saturation, brightness, weather resistance, OHP transparency and dispersion property in a toner.

The colorant may be added in an amount of from 4 to 15% by weight based on the total weight of the solid contents constituting the toner. In the case where a magnetic material is used as a black colorant, it may be added in an amount of from 12 to 240% by weight, as being different from the other colorants.

The mixing amount of the colorant is the necessary amount for ensuring the coloring property upon fixing. The center diameter (median diameter) of the colorant particles in the toner is preferably from 100 to 330 nm, by which the OHP transparency and the coloring property can be favorably ensured.

The center diameter (median diameter) of the colorant particles can be measured, for example, with a laser diffraction particle size distribution measuring apparatus (Model LA-920, produced by Horiba, Ltd.).

In the case where the toner is used as a magnetic toner, magnetic powder may be contained. A substance that is magnetized in a magnetic field may be used, and examples thereof include ferromagnetic powder, such as iron, cobalt and nickel, and such a compound as ferrite and magnetite. In the case where the toner is obtained in an aqueous phase, the aqueous phase transition property of the magnetic material should be considered, and it is preferred that the surface of the magnetic material is modified in advance, for example, by a hydrophobic treatment.

An internal additive may be used, examples of which include a magnetic material, such as a metal, an alloy or a compound containing the metal, e.g., ferrite, magnetite, reduced iron, cobalt, nickel and manganese, and a charge controlling agent that is ordinarily used, such as a quaternary ammonium salt compound, a nigrosine compound, a dye containing a complex of aluminum, iron, chromium or the like, a triphenylmethane pigment, and a material that is hardly soluble in water is preferably used from the standpoint of control of the ion strength concerning the stability upon aggregation and integration, and reduction in waste water pollution.

The particle diameters of the releasing agent particles and the colorant particles can be measured, for example, with a laser diffraction particle size distribution measuring apparatus (Model LA-920, produced by Horiba, Ltd.). In the invention, the toner for developing an electrostatic image contains a releasing agent, and therefore it is preferred that after aggregating the resin particles, the colorant particles and the releasing agent particles, another resin particle dispersion is added to attach resin particles onto the surface of the aggregated particles, from the standpoint of ensuring the charging property and the durability.

The toner for developing an electrostatic image produced by the production method of the invention preferably has an accumulated volume average particle diameter $D_{50}$ of from 3.0 to 9.0 μm, and more preferably from 3.0 to 7.0 μm. In the case where $D_{50}$ is 3.0 μm or more, it is preferred since a suitable adhesion force can be obtained to provide favorable developing property. In the case where $D_{50}$ is 9.0 μm or less, it is preferred since a good resolution of an image can be obtained.

The resulting toner preferably has a volume average particle size distribution index GSDv of 1.30 or less. In the case where GSDv is 1.30 or less, it is preferred since a good resolution can be obtained, and an image defect due to scattering of the toner and fogging can be prevented from occurring.

The accumulated volume average particle diameter $D_{50}$ and the volume average particle size distribution index GSDv are obtained in the following manner. Based on the particle size distribution measured by a measuring apparatus, such as Coulter Counter TAIII (produced by Nikkaki Co., Ltd.) and Multisizer II (produced by Nikkaki Co., Ltd.), cumulative distributions of the volume and the number are drawn from the small diameter side with respect to the divided particle size ranges (channels). The particle diameters at a cumulative amount of 16% are designated as $D_{16V}$ for volume and $D_{16P}$ for number, the particle diameters at a cumulative amount of 50% are designated as $D_{50V}$ for volume and $D_{50P}$ for number, and the particle diameters at a cumulative amount of 84% are designated as $D_{84V}$ for volume and $D_{84P}$ for number. By using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

The resulting toner preferably has a shape factor SF1 of from 100 to 140 from the standpoint of image forming property, and is more preferably from 110 to 135. The shape factor SF1 can be obtained in the following manner. An optical micrograph of the toner scattered on slide glass is imported into a Luzex image analyzer through a video camera, and 50 or more toner particles are measured for the maximum length (ML) and the projected area (A). The shape factor SF1 is obtained by the following equation, and an average value thereof is obtained.

$$SF1 = \frac{(ML)^2}{A} \times \frac{\pi}{4} \times 100$$

wherein ML represents the maximum length of the toner particles, and A represents the projected area of the particles.

After drying the resulting toner, in order to imparting flowability and to improve the cleaning property, inorganic particles, such as silica, alumina, titania and calcium carbonate, and resin particles, such as a vinyl resin, polyester and silicone, may be added as an external additive to the surface of the toner particles in a dry state under application of a shearing force, as similar to an ordinary toner.

Upon attaching the external additive to the surface of the toner in an aqueous medium, any kind of external additives to be added to the surface of an ordinary toner, such as silica, alumina, titania, calcium carbonate, magnesium carbonate and tricalcium phosphate, as examples of the inorganic particles, may be used by dispersing with an ionic surfactant, a polymer acid or a polymer base.

The toner obtained by the method for producing a toner for developing an electrostatic image according to the invention is used as a developer for developing an electrostatic image. The developer is not particularly limited as far as the toner for developing an electrostatic image is contained, and may have a suitable formulation depending on purpose. A one-component developer for developing an electrostatic image can be prepared by using solely the toner for developing an electrostatic image, and a two-component developer for developing an electrostatic image can be prepared by using the toner with a carrier.

The carrier is not particularly limited, and examples thereof include magnetic material particles, such as iron powder, ferrite, iron oxide powder and nickel; a resin coated carrier obtained by coating the magnetic material particles with a resin, such as a styrene resin, a vinyl resin, an ethylene resin, a rosin resin, a polyester resin and a melamine resin, to form a resin coated layer; and a magnetic material dispersed carrier obtained by dispersing magnetic material particles in a binder resin. Among these, the resin coated carrier is particularly preferably used since the charging property of the toner and the total resistance of the carrier can be controlled by the constitution of the resin coated layer.

The mixing ratio of the toner of the invention and the carrier in the two-component developer for developing an electrostatic image is generally from 2 to 10 parts by weight of the toner per 100 parts by weight of the carrier. The preparation method of the developer is not particularly limited, and examples thereof include a method of mixing with a V-blender or the like.

(Method for Forming Image)

The toner for developing an electrostatic image and the developer for developing an electrostatic image according to the invention may be applied to a method for forming an image of an ordinary electrostatic image developing system (electrophotographic system).

The method for forming an image of the invention contains the steps of: forming an electrostatic latent image on a surface of a latent image carrying member; developing the electrostatic latent image formed on the surface of the latent image carrying member with a developer containing a toner to form a toner image; transferring the toner image formed on the surface of the latent image carrying member to a surface of a transfer material; and fixing the toner image transferred to the surface of the transfer material by heating, and the toner for developing an electrostatic image according to the invention is used as the toner, or the developer for developing an electrostatic image according to the invention is used as the developer.

As the aforementioned steps constituting the method, steps having been known in the field of an image forming method may be utilized, which are described, for example, in JP-A-56-40868 and JP-A-49-91321. The method for forming an image of the invention may contain any step other than the aforementioned steps, preferred examples of which include a cleaning step of removing the developer for developing an electrostatic image remaining on the electrostatic latent image carrying member. The method for forming an image of the invention preferably contains a recycling step. In the recycling step, the toner for developing an electrostatic image thus recovered in the cleaning step is transferred to the developer layer. The method for forming an image containing the recycling step can be practiced by using an image forming apparatus, such as a duplicator and a facsimile machine, having a toner recycling system. The method for forming an image of the invention may be applied to such a recycling system that the cleaning step is omitted, but the toner is recovered simultaneously with development.

Examples of the latent image carrying member include an electrophotographic photoreceptor and a dielectric recording material.

In the case of the electrophotographic photoreceptor, the surface of the electrophotographic photoreceptor is uniformly charged with a charging device, such as a corotron charging device and a contact charging device, and then exposed to form an electrostatic latent image (latent image forming step). Thereafter, the surface of the photoreceptor is made in contact with or is made close to a developing roll having a developer layer formed on the surface thereof to attach the toner particles to the electrostatic latent image, whereby a toner image is formed on the electrophotographic photoreceptor (developing step). The toner image thus formed is then transferred to a surface of a transfer member, such as paper, with a corotron charging device or the like (transferring step). The toner image thus transferred to the surface of the transfer material is fixed by heating with a fixing device (fixing step), and thus a final toner image is formed.

EXAMPLE

An aspect of the invention will be described with reference to the following example, but the aspect of the invention is not construed as being limited thereto.

The toner is produced in the following manner in the examples. The resin particle dispersion liquid and the releasing agent particle dispersion liquid shown below are prepared and mixed at a prescribed ratio, to which an aggregating agent is added, to produce aggregated particles. An inorganic hydroxide is added to the dispersion liquid to adjust the pH in the system from weak acidity to neutral, and then the dispersion liquid is heated to a temperature equal to or higher than the glass transition temperature of the resin particles to fuse and integrate the particles. After completing the reaction, the steps of sufficient washing, solid-liquid separation and drying are carried out to obtain a desired toner. The measurement methods and the preparation methods are described below.

(Measurement Method of Melting Temperature and Glass Transition Temperature)

The glass transition temperature (Tg) of the amorphous resin and the melting temperature (Tm) of the crystalline resin are measured with a differential scanning calorimeter (DSC50, produced by Shimadzu Corp.) at a temperature of from room temperature to 150° C. at a temperature increasing rate of 10° C. per minute. The glass transition temperature is designated as a temperature at an intersecting temperature of the base line and the rising line in the endothermic range, and the melting temperature is designated as a temperature at the top of the endothermic peak.

(Measurement Method of Weight Average Molecular Weight)

The values of the weight average molecular weight Mw and the number average molecular weight Mn in an aspect of the invention are measured in the following measurement method. The weight average molecular weight Mw and the number average molecular weight Mn are measured by gel permeation chromatography (GPC) under the following conditions.

A solvent (tetrahydrofuran) is flowed at a flow rate of 1.2 mL/min at a temperature of 40° C., and 3 mg of a specimen in the form of a tetrahydrofuran solution having a concentration of 0.2 g per 20 mL is injected for measurement. In the measurement of the molecular weight of the specimen, such measurement conditions are selected that the molecular weight of the specimen is encompassed in the range where a linear relationship is obtained between the logarithm of the calibration curve obtained with a monodisperse polystyrene standard sample containing plural kinds of molecular weight and the count number.

The reliability of the measurement results is confirmed in such a manner that the NBS706 polystyrene standard sample exhibits a weight average molecular weight Mw of $28.8\times10^4$ and a number average molecular weight Mn of $13.7\times10^4$. The GPC columns may be any type of columns that satisfy the aforementioned conditions, and specifically TSK-GEL and GMH (produced by Tosoh Corp.) is used.

(Measurement of Volume Average Particle Diameter ($D_{50}$) and Volume Average Particle Size Distribution Index (GSDv))

The volume average particle diameter and the volume average particle size distribution index in an aspect of the invention are measured by using Coulter Counter TAII (produced by Beckman Coulter, Inc.) and ISOTON-II (produced by Beckman Coulter, Inc.) as an electrolytic solution.

In the measurement, from 0.5 to 50 mg of a specimen is added to 2 mL of a surfactant as a dispersant, preferably a 5% aqueous solution of sodium alkylbenzenesulfonate. The solution is added to 100 to 150 mL of the electrolytic solution. The electrolytic solution having the specimen suspended therein is dispersed with an ultrasonic dispersing device for 1 minute, and measured for particle size distribution of particles having a diameter of from 2 to 60 μm with Coulter Counter TAII using an aperture of 100 μm, and then the volume average particle diameter ($D_{50}$) and the volume average particle size distribution index (GSDv) are obtained in the aforementioned manner. The number of particles measured is 50,000.

(Measurement of Metallic Element Contained in Polycondensation Resin and Condensation Compound)

The measurement of a metallic element contained in the toner may be carried out by fluorescent X-ray measurement and XPS measurement of the toner, and taking the detection minimum limit and the accuracy into consideration, a fluorescent X-ray measuring apparatus is preferably used. A sample is prepared by molding by compressing the toner and measured for all the components qualitatively and quantitatively, and the contents of the aforementioned metallic elements in the toner are calculated by using calibration lines separately prepared. The measuring device used is XRF1500 (produced by Shimadzu Corp.).

(Measurement of Sulfur Component in Polycondensation Resin and Condensation Compound)

A sample is prepared in the same manner as in the measurement of a metallic element, and the content of a sulfur component in the toner is calculated by using a calibration line separately prepared. The measuring device used is XRF1500 (produced by Shimadzu Corp.).

(Preparation of Resin Particle Dispersion Liquid)

(1) Preparation of Binder Resin Particle Dispersion Liquid (C1)

| | |
|---|---|
| Dodecylbenzenesulfonic acid | 1.66 parts by weight |
| Ion exchanged water | 200 parts by weight |

The aforementioned components are mixed and dissolved in a thermostatic bath at 70° C.

| | |
|---|---|
| 1,9-Nonanediol | 10.0 parts by weight |
| Dodecanedioic acid | 14.0 parts by weight |

The aforementioned components are mixed and melted by heating to 120° C., and put in the dodecylbenzenesulfonic acid aqueous solution, and the mixture is emulsified with a homogenizer (Ultra Turrax, produced by IKA Works Inc.) at 8,000 rpm for 5 minutes and further emulsified in an ultrasonic bath for 5 minutes. The emulsion is then placed in a reactor equipped with an agitator, and polycondensation is carried out in a nitrogen atmosphere at 70° C. for 24 hours.

According to the procedure, a crystalline polyester resin particle dispersion liquid (C1) having a median diameter of the particles of 310 nm, a melting temperature of 70° C. and a weight average molecular weight of 4,200 is obtained.

(2) Preparation of Binder Resin Particle Dispersion Liquid (C2)

| | |
|---|---|
| Dodecylbenzenesulfonic acid | 1.66 parts by weight |
| Cetyl alcohol | 1.5 parts by weight |
| Ion exchanged water | 200 parts by weight |

The aforementioned components are mixed and dissolved in a thermostatic bath at 70° C.

| | |
|---|---|
| 1,6-Hexanediol | 15.0 parts by weight |
| Sebacic acid | 25.0 parts by weight |
| Styrene | 5.0 parts by weight |

The aforementioned components are mixed and melted by heating to 120° C., and put in the dodecylbenzenesulfonic acid aqueous solution, and the mixture is emulsified with a homogenizer (Ultra Turrax, produced by IKA Works Inc.) at 8,000 rpm for 5 minutes and further emulsified in an ultrasonic bath for 5 minutes. The emulsion is then placed in a reactor equipped with an agitator, and polycondensation is carried out in a nitrogen atmosphere at 70° C. for 24 hours.

A solution obtained by dissolving 0.3 part by weight of ammonium persulfate in 5 parts by weight of ion exchanged water is added to the resin particle dispersion liquid, and polymerization is further carried out in a nitrogen atmosphere for 6 hours.

According to the procedure, a crystalline polyester resin particle dispersion liquid (C2) having a median diameter of the particles of 350 nm, a melting temperature of 56° C. and a weight average molecular weight of 3,800 is obtained.

(3) Preparation of Binder Resin Particle Dispersion Liquid (C3)

| | |
|---|---|
| p-Toluenesulfonic acid | 0.1 part by weight |
| Ion exchanged water | 200 parts by weight |

The aforementioned components are mixed and dissolved.

| | |
|---|---|
| 1,9-Nonanediol | 10.0 parts by weight |
| Dodecanedioic acid | 14.0 parts by weight |

A resin particle dispersion liquid is prepared in the same manner as in the resin particle dispersion liquid (C1). According to the procedure, a crystalline polyester resin particle dispersion liquid (C3) having a median diameter of 1.3 μm, a weight average molecular weight of 2,050, and a melting temperature of 69° C. is obtained.

(4) Preparation of Binder Resin Particle Dispersion Liquid (C4)

| | |
|---|---|
| 1,9-Nonanediol | 10.0 parts by weight |
| Dodecanedioic acid | 14.0 parts by weight |
| Dibutyl tin oxide | 0.5 part by weight (0.2% by mol) |

The aforementioned components are placed in a reactor equipped with an agitator, and polycondensation is carried out at 220° C. for 24 hours to obtain a uniform crystalline polyester resin. The cooled polyester is heated to 120° C. and put in 200 g of ion exchanged water heated to 95° C., and at the time when the polyester resin is melted, the mixture is agitated with a homogenizer (Ultra Turrax, produced by IKA Works Inc.) at 8,000 rpm. Thereafter, the mixture is dispersed with a pressure discharge homogenizer (Gorin Homogenizer, produced by Gorin Inc.) to obtain a resin particle dispersion liquid (C4) having a median diameter of 490 nm. The weight average molecular weight (Mw) is 21,000, and the melting temperature is 72° C.

(5) Preparation of Binder Resin Particle Dispersion Liquid (C5)

| | |
|---|---|
| p-Toluenesulfonic acid | 24.0 parts by weight |
| Ion exchanged water | 190 parts by weight |

The aforementioned components are mixed and dissolved.

| | |
|---|---|
| 1,9-Nonanediol | 10.0 parts by weight |
| Dodecanedioic acid | 14.0 parts by weight |

The aforementioned components are mixed and melted by heating to 120° C., and put in the aforementioned dodecylbenzenesulfonic acid aqueous solution, and the mixture is emulsified with a homogenizer (Ultra Turrax, produced by IKA Works Inc.) at 8,000 rpm for 5 minutes and further emulsified in an ultrasonic bath for 5 minutes. The emulsion is then placed in a reactor equipped with an agitator, and polycondensation is carried out in a nitrogen atmosphere at 70° C. for 24 hours.

According to the procedure, a crystalline polyester resin particle dispersion liquid (C5) having a median diameter of the particles of 120 nm, a melting temperature of 70° C. and a weight average molecular weight of 1,800 is obtained.

(Preparation of Releasing Agent Particle Dispersion Liquid)

(1) Preparation of Releasing Agent Particle Dispersion Liquid (W1)

| | |
|---|---|
| Docecylbenzenesulfonic acid | 1.66 parts by weight |
| Ion exchanged water | 200 parts by weight |
| Palmitic acid | 47 parts by weight |
| Pentaerythritol | 6.5 parts by weight |

An ester compound particle dispersion liquid is prepared in the same manner as in the resin particle dispersion liquid (C1). According to the procedure, a releasing agent particle dispersion liquid (condensation compound particle dispersion liquid) (W1) having a median diameter of the particles of 330 nm and a melting temperature of 72° C. is obtained.

(2) Preparation of Releasing Agent Particle Dispersion Liquid (W2)

| | |
|---|---|
| p-Toluenesulfonic acid | 1.0 parts by weight |
| Ion exchanged water | 200 parts by weight |

The aforementioned components are mixed and dissolved.

| | |
|---|---|
| Behenic acid | 27 parts by weight |
| Behenyl alcohol | 25 parts by weight |

The aforementioned components are mixed and melted to 90° C., and then put in the aforementioned aqueous solution, and an ester compound particle dispersion liquid is prepared in the same manner as in the resin particle dispersion liquid (C1). According to the procedure, a releasing agent particle dispersion liquid (condensation compound particle dispersion liquid) (W2) having a median diameter of the particles of 290 nm and a melting temperature of 69° C. is obtained.

| | |
|---|---|
| Polyethylene wax (Polywax 725, produced by Toyo Petrolight Co., Ltd., melting temperature: 103° C.) | 30 parts by weight |
| Cationic surfactant (Sanisol B50, produced by Kao Corp.) | 3 parts by weight |
| Ion exchanged water | 67 parts by weight |

The aforementioned components are sufficiently dispersed with a homogenizer (Ultra Turrax, produced by IKA Works Inc.) under heating to 120° C., and then further dispersed with a pressure discharge homogenizer (Gorin Homogenizer, produced by Gorin Inc.) to obtain a releasing agent particle dispersion (W3). The releasing agent particles in the resulting dispersion liquid have a median diameter of 580 nm and a melting temperature of 103° C.

(4) Preparation of Releasing Agent Particle Dispersion Liquid (W4)

| | |
|---|---|
| p-Toluenesulfonic acid | 15 parts by weight |
| Ion exchanged water | 190 parts by weight |

The aforementioned components are mixed and dissolved.

| | |
|---|---|
| Behenic acid | 27 parts by weight |
| Behenyl alcohol | 25 parts by weight |

The aforementioned components are mixed and melted to 90° C., and then put in the aforementioned aqueous solution, and an ester compound particle dispersion liquid is prepared in the same manner as in the resin particle dispersion liquid (C1). According to the procedure, a releasing agent particle dispersion liquid (condensation compound particle dispersion liquid) (W4) having a median diameter of the particles of 400 nm and a melting temperature of 68° C. is obtained.

(Preparation of Cyan Pigment Dispersion Liquid (C1))

| | |
|---|---|
| Cyan pigment (PB15:3, produced by Dainichiseika Colour & Chemicals Mfg. Co., Ltd.) | 20 parts by weight |
| Anionic surfactant (Neogen R, produced by Dai-ichi Kogyo Seiyaku Co., Ltd.) | 2 parts by weight |
| Ion exchanged water | 78 parts by weight |

The aforementioned components are mixed and dispersed with a homogenizer (Ultra Turrax, produced by IKA Works Inc.) for 5 minutes and with an ultrasonic bath for 10 minutes to obtain a cyan pigment dispersion liquid. The pigment in the dispersion liquid has a number average particle diameter $D_{50n}$ of 121 nm. Ion exchanged water is added to the dispersion liquid to adjust the solid concentration in the dispersion liquid to 20%.

(Preparation of Resin Particle Dispersion Liquid A)

| | |
|---|---|
| Styrene | 460 parts by weight |
| n-Butyl acrylate | 140 parts by weight |
| Acrylic acid | 12 parts by weight |
| Dodecanethiol | 9 parts by weight |

The aforementioned components are mixed to prepare a solution.

Separately, 12 parts by weight of an anionic surfactant (Dowfax, produced by Dow Chemical Inc.) is dissolved in 250 parts by weight of ion exchanged water, into which the aforementioned solution is put, followed by dispersing in a flask for emulsification (monomer emulsion A).

1 part by weight of the same anionic surfactant (Dowfax, produced by Dow Chemical Inc.) is dissolved in 555 parts by weight of ion exchanged water, and the solution is charged in a polymerization flask.

The polymerization flask is sealed and attached with a reflux tube, and heated to 75° C. over water bath under gradually stirring, and then the temperature maintained.

A solution obtained by dissolving 9 parts by weight of ammonium persulfate in 43 parts by weight of ion exchanged water is added dropwise to the polymerization flask through a metering pump over 20 minutes, and then the monomer emulsion A is added dropwise thereto through a metering pump over 200 minutes.

Thereafter, the polymerization flask is maintained at 75° C. for 3 hours under gradually stirring to complete polymerization.

According to the procedure, a noncrystalline resin particle dispersion liquid A having a median diameter of the particles of 240 nm, a glass transition temperature of 53.0° C., a weight average molecular weight of 28,000 and a solid content of 42%. The resin particles exhibit no distinct endothermic peak.

Example 1

(Production of Toner (1))

| | |
|---|---|
| Resin particle dispersion liquid (C1) | 120 parts by weight |
| Resin particle dispersion liquid A | 40 parts by weight |
| Releasing agent particle dispersion liquid (W1) | 38 parts by weight |
| Cyan pigment dispersion liquid | 60 parts by weight |

-continued

| | |
|---|---|
| 10% by weight aqueous solution of polyaluminum chloride (PAC 100W, produced by Asada Chemical Industry Co., Ltd.) | 15 parts by weight |
| 1% nitric acid aqueous solution | 3 parts by weight |

The aforementioned components are dispersed with a homogenizer (Ultra Turrax, produced by IKA Works Inc.) at 5,000 rpm for 3 minutes in a round bottom stainless steel flask, which is then closed with a lid having an agitation device having a magnetic seal, a thermometer and a pH meter. The flask is placed on a mantle heater, and heated to 62° C. at a temperature increasing rate of 1° C. per minute under stirring at the lowest rotation number capable of stirring the entire dispersion liquid in the flask. The temperature is maintained at 62° C. for 30 minutes, and then the particle diameter of the aggregated particles is confirmed. Immediately after completing the temperature increase, 50 parts by weight of the resin particle dispersion liquid (C1) is added, and after maintaining for 30 minutes, a sodium hydroxide aqueous solution is added until the pH of the system reaches 6.5, followed by heating to 97° C. at a temperature increasing rate of 1° C. per minute. After completing the temperature increase, a nitric acid aqueous solution is added to adjust the pH in the system to 5.0, and then the system is maintained for 10 hours to fuse the aggregated particles by heating. Thereafter, the system is cooled to 50° C. and adjusted to pH 12.0 by adding a sodium hydroxide aqueous solution, followed by maintaining for 10 minutes. The dispersion liquid is then taken out from the flask, sufficiently filtered and washed by using ion exchanged water, dispersed in ion exchanged water to a solid content of 10% by weight, stirred for 10 minutes at pH 3.0 adjusted by adding nitric acid, and again sufficiently filtered and washed by using ion exchanged water to obtain slurry, which is freeze-dried to obtain a cyan toner (toner C1).

To the cyan colored particles, silica ($SiO_2$) particles having an average primary particle diameter of 40 nm and having been subjected to a surface hydrophobic treatment with hexamethyldisilazane (hereinafter, sometimes abbreviated as HMDS) and metatitanic acid compound particles having an average primary particle diameter of 20 nm as a reaction product of metatitanic acid and isobutyltrimethoxysilane are added in an amount of 1% by weight each, and mixed with a Henschel mixer to produce an externally added cyan toner.

The toner has an accumulated volume average particle diameter $D_{50}$ of 5.8 μm, a volume average particle size distribution index GSDv of 1.24 and a shape factor of 128. Observation of the dispersion state of the releasing agent and the colorant in the particles with a TEM reveals that no aggregation is observed, and favorable dispersion state is obtained.

The accumulated volume average particle diameter $D_{50}$ and the volume average particle size distribution index GSDv of the toner are measured with a laser diffraction particle size distribution measuring apparatus (Model LA-700, produced by Horiba, Ltd.), and the shape factor is obtained by observation with a Luzex image analyzer.

Example 2

(Production of Toner (2))

| | |
|---|---|
| Resin particle dispersion liquid (C2) | 160 parts by weight |
| Releasing agent particle dispersion liquid (W2) | 38 parts by weight |
| Cyan pigment dispersion liquid | 60 parts by weight |

-continued

| | |
|---|---|
| 10% by weight aqueous solution of polyaluminum chloride (PAC 100W, produced by Asada Chemical Industry Co., Ltd.) | 15 parts by weight |
| 1% nitric acid aqueous solution | 3 parts by weight |

A toner (2) is produced in the same manner as in Example 1 except that the aforementioned formulation is used, and the same analysis is carried out.

Example 3

(Production of Toner (3))

A toner (3) is produced in the same manner as in Example 1 except that the resin particle dispersion (C1) is changed to the resin particle dispersion (C3), and the same analysis is carried out.

Comparative Examples 1 to 4

In Comparative Examples 1, 3 and 4, cyan toners are produced in the same manner as in Example 1 except that the resin particle dispersion liquid and the releasing agent particle dispersion liquid are changed to those shown in Table 1, and in Comparative Example 2, a cyan toner is produced in the same manner as in Example 2 except that the resin particle dispersion liquid and the releasing agent particle dispersion liquid are changed to those shown in Table 1.

(Production of Carrier)

A methanol solution containing 0.1 part by weight of γ-aminopropyltriethoxysilane is added to and coated on 100 parts by weight of Cu—Zn ferrite particles having a volume average particle diameter of 40 μm by using a kneader, and after distilling out methanol, the particles are heated to 120° C. for 2 hours to harden the silane compound completely. A solution obtained by dissolving a perfluorooctylethyl methacrylate-methyl methacrylate copolymer (copolymerization ratio: 40/60) in toluene is added to the particles, and a resin coated carrier having a coated amount of the perfluorooctylethyl methacrylate-methyl methacrylate copolymer of 0.5% by weight is produced by using a vacuum depressurizing kneader.

(Production of Developer)

4 parts by weight each of the toners are mixed with 100 parts by weight of the resin coated carrier, respectively, to produce developers for developing an electrostatic image. The developers are used for the following evaluation.

(Evaluation of Dispersion Uniformity with TEM)

An ultrathin strip specimen of the toner is prepared with a cryostat and is observed with a transmission electron microscope (TEM) to evaluate visually the dispersed states of the releasing agent and the colorant in the toner.

(Evaluation of OHP Transparency)

The evaluation of OHP transparency of the toner is carried out in such a manner that a fixed image of the toner is formed on an OHP sheet (V516, produced by Fuji Xerox Co., Ltd.) at a contact time with a fixing roll of 0.1 second and a set temperature of 180° C. by using an image forming apparatus (a modified machine of DocuCentre Color 500, produced by Fuji Xerox Co., Ltd.), and the transmissibility of the image is visually evaluated with visible light.

A: Good transmissibility

B: somberness or turbidity slightly observed

C: somberness or turbidity observed

Since the releasing agent is not permeated into an OHP sheet, and therefore, in the case where the releasing agent is aggregated in the toner or exposed to the surface of the toner, the releasing agent is attached to the fixing roll to bring about a phenomenon referred to as wax offset, in which a trace of the releasing agent is formed on an OHP sheet on the subsequent rotation of the fixing roll.

(Evaluation of Image Uniformity on OHP Sheet)

A solid fixed image of the toner is formed by using the aforementioned modified machine, and evaluated for uniformity visually with visible light.

A: Good uniformity of solid image

B: Blur or unevenness slightly observed in image

C: Blur or unevenness observed in image

The results obtained are shown in Table 1 below.

TABLE 1

| | Example 1 | Example 2 | Example 3 |
|---|---|---|---|
| Binder resin | C1 | C2 | C3 |
| Releasing agent | W1 | W2 | W1 |
| Other component | Resin A | none | Resin A |
| Particle diameter ratio (C/W) | 310/330 | 350/290 | 1,300/330 |
| Toner diameter (μm) | 5.8 | 5.9 | 5.9 |
| GSDv | 1.24 | 1.24 | 1.26 |
| Sulfur component content (ppm) | 2,000 | 1,800 | 1,200 |
| Metallic element content (ppm) | not detected | not detected | not detected |
| Shape factor | 128 | 127 | 129 |
| TEM dispersion uniformity | good | good | slightly aggregated |
| Transmissibility | A | A | A |
| Image uniformity | A | A | A |

| | Comparative Example 1 | Comparative Example 2 | Comparative Example 3 | Comparative Example 4 |
|---|---|---|---|---|
| Binder resin | C4 | C2 | C5 | C4 |
| Releasing agent | W1 | W3 | W4 | W3 |
| Other component | Resin A | none | Resin A | Resin A |
| Particle diameter ratio (C/W) | 490/330 | 350/580 | 120/400 | 490/580 |
| Toner diameter (μm) | 5.8 | 5.9 | 5.5 | 5.8 |
| GSDv | 1.26 | 1.25 | 1.25 | 1.27 |

TABLE 1-continued

| | | | | |
|---|---|---|---|---|
| Sulfur component content (ppm) | 1,000 | 1,400 | 27,000 | 700 |
| Metallic element content (ppm) | 300 | 50 | not detected | 50 |
| Shape factor | 129 | 129 | 125 | 128 |
| TEM dispersion uniformity | aggregated | aggregated | aggregated and exposure on particle surface | aggregated and exposure on particle surface |
| Transmissibility | B | C | C | C |
| Image uniformity | B | B | C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

According to an aspect of the invention, such a toner for developing an electrostatic image that is improved in dispersibility of a releasing agent in the toner, and a method for producing the same may be provided. According to an aspect of the invention, a developer for developing an electrostatic image and a method for forming an image that utilize the same may be provided.

What is claimed is:

1. A toner for developing an electrostatic image, the toner comprising:

a binder resin, a releasing agent in an amount of from 5% to 30% by weight, and a colorant in an amount of from 4% to 15% by weight, wherein the binder resin comprises a polycondensation resin obtained by a polycondensation reaction of 1,9-nonanediol with 1,10-decane dicarboxylic acid, 1,9-nonanediol with sebacic acid, or 1,6-hexanediol with sebacic acid in the presence of a polycondensation catalyst, the releasing agent comprises a condensation compound that is a crystalline ester obtained by a condensation reaction of an alcohol and a carboxylic acid in the presence of a condensation catalyst, wherein the carboxylic acid is palmitic acid or behenic acid, and the alcohol is pentaerythritol or behenyl alcohol the releasing agent further comprises a wax, the toner contains a metallic element derived from the polycondensation catalyst and the condensation catalyst in an amount up to 10 ppm, the metallic element selected from the group of consisting of tin, titanium, antimony, beryllium, strontium, germanium and a rare earth metal, and the toner contains a sulfur component in an amount of from about 100 ppm to about 20,000 ppm.

2. The toner for developing an electrostatic image according to claim 1, wherein the binder resin comprises the polycondensation resin in an amount of about 40% by weight or more.

3. The toner for developing an electrostatic image according to claim 1, wherein the binder resin comprises a noncrystalline polyester in an amount of from about 1% to about 90% by weight.

4. The toner for developing an electrostatic image according to claim 3, wherein the noncrystalline polyester has a glass transition temperature Tg of from about 40° C. to about 100° C.

5. The toner for developing an electrostatic image according to claim 3, wherein the noncrystalline polyester has a weight average molecular weight of from about 1,000 to about 60,000 as measured by a gel permeation chromatography (GPC) molecular weight measuring method of a component soluble in tetrahydrofuran (THF).

6. The toner for developing an electrostatic image according to claim 1, wherein the binder resin comprises a crystalline polyester.

7. The toner for developing an electrostatic image according to claim 6, wherein the crystalline polyester has a crystal melting temperature Tm of from about 50° C. to about 120° C.

8. The toner for developing an electrostatic image according to claim 6, wherein the crystalline polyester has a weight average molecular weight of from about 1,000 to about 60,000 as measured by a gel permeation chromatography (GPC) molecular weight measuring method of a component soluble in tetrahydrofuran (THF).

9. The toner for developing an electrostatic image according to claim 1, wherein the condensation compound comprises the metallic element present in an amount up to 7.5 ppm.

10. The toner for developing an electrostatic image according to claim 1, which has a volume average particle size distribution index GSDv of about 1.30 or less.

11. The toner for developing an electrostatic image according to claim 1, which has a shape factor SF1 of from about 100 to about 140.

12. A method for producing the toner for developing an electrostatic image as claimed in claim 1, the method comprising:

aggregating binder resin particles comprising a polycondensation resin and releasing agent particles comprising a condensation compound in an aqueous medium; and fusing and integrating the aggregated particles by heating.

13. A developer for developing an electrostatic image comprising:

a toner for developing an electrostatic image as claimed in claim 1; and a carrier.

14. A method for forming an image comprising:

forming an electrostatic latent image on a surface of a latent image carrying member;

developing the electrostatic latent image formed on the surface of the latent image carrying member with a developer comprising a toner to form a toner image;

transferring the toner image formed on the surface of the latent image carrying member to a surface of a transfer material; and fixing the toner image transferred to the surface of the transfer material by heating, wherein the toner is a toner for developing an electrostatic image as claimed in claim 1.

15. A method for forming an image comprising:

forming an electrostatic latent image on a surface of a latent image carrying member;

developing the electrostatic latent image formed on the surface of the latent image carrying member with a developer comprising a toner to form a toner image;

transferring the toner image formed on the surface of the latent image carrying member to a surface of a transfer material; and fixing the toner image transferred to the surface of the transfer material by heating, wherein the developer is a developer for developing an electrostatic image as claimed in claim 13.

16. A toner for developing an electrostatic image, the toner comprising:

a binder resin, a releasing agent in an amount of from 5% to 30% by weight, and a colorant in an amount of from 4% to 15% by weight, wherein the binder resin comprises a polycondensation resin obtained by a polycondensation reaction of 1,9-nonanediol with 1,10-decane dicarboxylic acid, 1,9-nonanediol with sebacic acid, or 1,6-hexanediol with sebacic acid in the presence of a polycondensation catalyst, the releasing agent comprises a condensation compound, the toner contains a metallic element derived from the polycondensation catalyst and the condensation catalyst in an amount up to 10 ppm, and the toner contains a sulfur component in an amount of from about 100 ppm to about 20,000 ppm, wherein the binder resin comprises a polyester which has a weight average molecular weight of from about 1,000 to about 60,000 as measured by a gel permeation chromatography (GPC) molecular weight measuring method of a component soluble in tetrahydrofuran (THF);

the releasing agent is a crystalline ester obtained by a condensation reaction of an alcohol and a carboxylic acid, wherein the carboxylic acid is palmitic acid or behenic acid, and the alcohol is pentaerythritol or behenyl alcohol, the releasing agent further comprises a wax; and the metallic element derived from the polycondensation catalyst and the condensation catalyst is selected from the group of consisting of tin, titanium, antimony, beryllium, strontium, germanium and a rare earth metal.

17. The toner for developing an electrostatic image according to claim 1, wherein the polycondensation catalyst contains a sulfur element derived from a sulfur-containing catalyst.

* * * * *